US006055835A

United States Patent [19]

Kawamizu et al.

[11] Patent Number: 6,055,835

[45] Date of Patent: May 2, 2000

[54] METHOD AND SYSTEM FOR SUPPRESSING FORMATION OF SCALE IN HOT FINISHING MILL SYSTEM

[75] Inventors: Tsutomu Kawamizu; Junsou Fukumori; Akira Kaya, all of Hiroshima; Kyung-Zoon Min, Tokyo, all of Japan; Yeo-Joo Choi, Cheonnnam; Soo-Chul Shin, Kyungbuk, both of Rep. of Korea

[73] Assignee: Mitsubishi Heavy Industries, Ltd., Tokyo, Japan

[21] Appl. No.: 09/201,783

[22] Filed: Dec. 1, 1998

[30] Foreign Application Priority Data

Dec. 5, 1997 [JP] Japan ..... 9-335234

[51] Int. Cl.[7] ..... B21B 45/00; B21B 45/04

[52] U.S. Cl. ..... 72/46; 72/39

[58] Field of Search ..... 72/39, 40, 46, 72/200, 201, 202, 364, 366.2; 29/424, 527.2

[56] References Cited

PUBLICATIONS

Abstract of JP 07–278662, published Apr. 7, 1994.

Abstract of JP 57–002829, published Jun. 10, 1980.

Abstract of JP 57–002828, published Jun. 10, 1980.

Abstract of DE 2743247, published Sep. 24, 1976.

*Primary Examiner*—Rodney Butler

[57] ABSTRACT

A plurality of finishing mills for finish rolling a rolled material are arranged in a row to form a finishing mill group. A scale breaker is provided at an entry side of the finishing mill group, a glass coating material application device for jetting molten glass to upper and lower surfaces of the rolled material to form a molten glass film is located at a delivery side of the scale breaker, and a molten glass film removing device for removing the molten glass film formed on the upper and lower surfaces of the rolled material is located at the delivery side of the finishing mill group.

19 Claims, 6 Drawing Sheets

METHOD AND SYSTEM FOR SUPPRESSING FORMATION OF SCALE IN HOT FINISHING MILL SYSTEM

BACKGROUND OF THE INVENTION

1. Field of the Invention

The present invention relates to a method and a system for suppressing formation of scale in a hot finishing mill system during rolling of a strip material.

2. Description of Related Art

When iron contacts a gas, such as oxygen or air, at a high temperature during rolling of a strip material, a film of the reaction product, i.e., scale, is formed on the surface of the strip material. This scale may exert an adverse influence, such as oxidation, on the strip material, and should be removed. The customary practice for removing scale formed on a strip material has been to spray a jet of pressurized water on the surface of the strip material.

FIG. 6, for example, is a schematic view of a scale removing device of a conventional hot finishing mill system.

In a conventional hot finishing mill system as shown in FIG. 6, a plurality of finishing mills, i.e., 1st to 7th finishing mills 101, 102, 103, 104, 105, 106, and 107, are located in a row along the direction of transport of a rolled material S downstream of a roughing mill (not shown) in the direction of transport. The finishing mills 101, 102, 103, 104, 105, 106, and 107 have a pair of (i.e., upper and lower) work rollers 201, 202, 203, 204, 205, 206, and 207, respectively. A finishing mill group 100 is constructed in this manner. On the entry side of the finishing mill group 100, a scale breaker 301 is provided for removing scale formed on the rolled material S. The scale breaker 301 has jet nozzles 302 above and below the rolled material S. These jet nozzles 302 direct jets of water at a high pressure of, say, 200 kgf/cm$^2$, to the upper and lower surfaces of the rolled material S to remove the scale.

Thus, the rolled material S transported after rough rolling from a slab by a roughing mill is conveyed to the entry side of the finishing mill group 100 where scale formed on the surfaces of the rolled material S is removed by the scale breaker 301 before finish rolling. In detail, water pressurized at, say, 200 kgf/cm$^2$, is directed through the upper and lower jet nozzles 302 to the upper and lower surfaces of the conveyed rolled material S to remove the adhering scale. The descaled rolled material S is carried to the finishing mill group 100 for rolling by the work rollers 201, 202, 203, 204, 205, 206, and 207 of the 1st to 7th finishing mills 101, 102, 103, 104, 105, 106, and 107, whereby it is sequentially finish rolled to predetermined thicknesses.

FIG. 3 is a graph illustrative of the relationship of a rolling load and the thickness of scale during descaling and finish rolling of the rolled material S. In this graph, the circle ○ signifies the rolling load of the scale removing device of the aforementioned conventional hot finishing mill system, the two-dot chain line represents the thickness of scale, A designates the time of scale removal by the scale breaker 301, and B, C, D, E, F, G, and H represent the times of finish rolling by the 1st to 7th finishing mills 101, 102, 103, 104, 105, 106, and 107, respectively. This graph shows that the scale thickness of the rolled material S decreases rapidly at the time A of scale removal by the scale breaker 301, and also decreases at the times B, C, D, E, F, G and H of finish rolling. Also, repeated rolling is found to reduce the thickness of the scale.

With such a hot finishing mill system, there is a demand for transporting the rolled material S at a high speed in order to raise the work efficiency. When the rolled material S is transported at a high speed, however, its front end collides with the outer peripheral surfaces of the work rollers 201, 202, 203, 204, 205, 206, and 207 when engaged into the finishing mills 101, 102, 103, 104, 105, 106, and 107. As a result, the work rolls 201, 202, 203, 204, 205, 206, and 207 can be deformed or damaged. With the hot finishing mill system, therefore, the rolled material S has to be transported at a low speed, with the result that the rolled material S takes a relatively long time until its engagement into the work rolls 201, 202, 203, 204, 205, 206, and 207, thus promoting the formation of scale. Under this scenario, the thickness of the scale on the rolled material S after rolling exceeds a limit of 5 $\mu$m. During finish rolling, this scale is imprinted into the surface of the rolled material S, causing defects. This markedly deteriorates the quality of the rolled material S.

SUMMARY OF THE INVENTION

The present invention, therefor, aims to solve this problem. Its primary object is to provide a method and a system for suppressing the formation of scale in a hot finishing mill system while improving the quality of the finished product, by inhibiting the formation of scale on a rolled material reliably.

According to a first aspect of the present invention which is designed to attain the above-described object, there is provided a method for suppressing the formation of scale in a hot finishing mill system during finish rolling of a strip material by a plurality of finishing mills located in a row and comprising the steps of:

removing scale at an entry side of the finishing mills; then forming a molten glass film on the surfaces of the strip material; and, thereafter finish rolling the strip material in this condition to a predetermined plate thickness.

According to a second aspect of the invention, there is provided the method for suppressing the formation of scale in the hot finishing mill system in accordance with the first aspect of the invention, wherein the molten glass film is subsequently removed at a delivery side of the most downstream finishing mill.

According to a third aspect of the invention, there is provided a system for suppressing the formation of scale in a hot finishing mill system, comprising:

a finishing mill for finish rolling a strip material, or a finishing mill group, including a plurality of the finishing mills located in a row;

scale removing means located at an entry side of the finishing mill or the finishing mill group; and glass coating material application means for applying a jet of glass coating material to upper and lower surfaces of the strip material to form a molten glass film, the glass coating material application means being located at the entry side of the finishing mill or the finishing mill group and at a delivery side of the scale removing means.

According to a fourth aspect of the invention, there is provided the system for suppressing the formation of scale in the hot finishing mill system in accordance with the third aspect of the invention, wherein molten glass film removing means for removing the molten glass film, formed on the upper and lower surfaces of the strip material, is located at the delivery side of the finishing mill or the finishing mill group.

According to a fifth aspect of the invention, there is provided a system for suppressing the formation of scale in a hot finishing mill system, comprising:

a finishing mill group including a plurality of finishing mills located in a row for finish rolling a strip material;

scale removing means provided at an entry side of the finishing mill group;

first glass coating material application means for applying a jet of glass coating material to upper and lower surfaces of the strip material to form a molten glass film, the first glass coating material application means being located at a delivery side of the scale removing means and at the entry side of one of the finishing mills of the plurality of finishing mills of the finishing mill group;

molten glass film removing means for removing the molten glass film formed on the upper and lower surfaces of the strip material, the molten glass film removing means being located at the delivery side of the finishing mill group; and second glass coating material application means for applying a jet of a glass coating material to upper and lower surfaces of the strip material to form an additional molten glass film, the second glass coating material application means being located at the delivery side of a predetermined number, for example, all of the other finishing mills of the plurality of finishing mills of the finishing mill group.

BRIEF DESCRIPTION OF THE DRAWINGS

The present invention will become more fully understood from the detailed description provided hereinafter and the accompanying drawings which are provided only for purposes of illustration and thus are not meant to be limitative of the present invention, and wherein.

DETAILED DESCRIPTION OF THE PREFERRED EMBODIMENT

Preferred embodiments of the present invention will now be described in detail with reference to the accompanying drawings.

Figure 1:
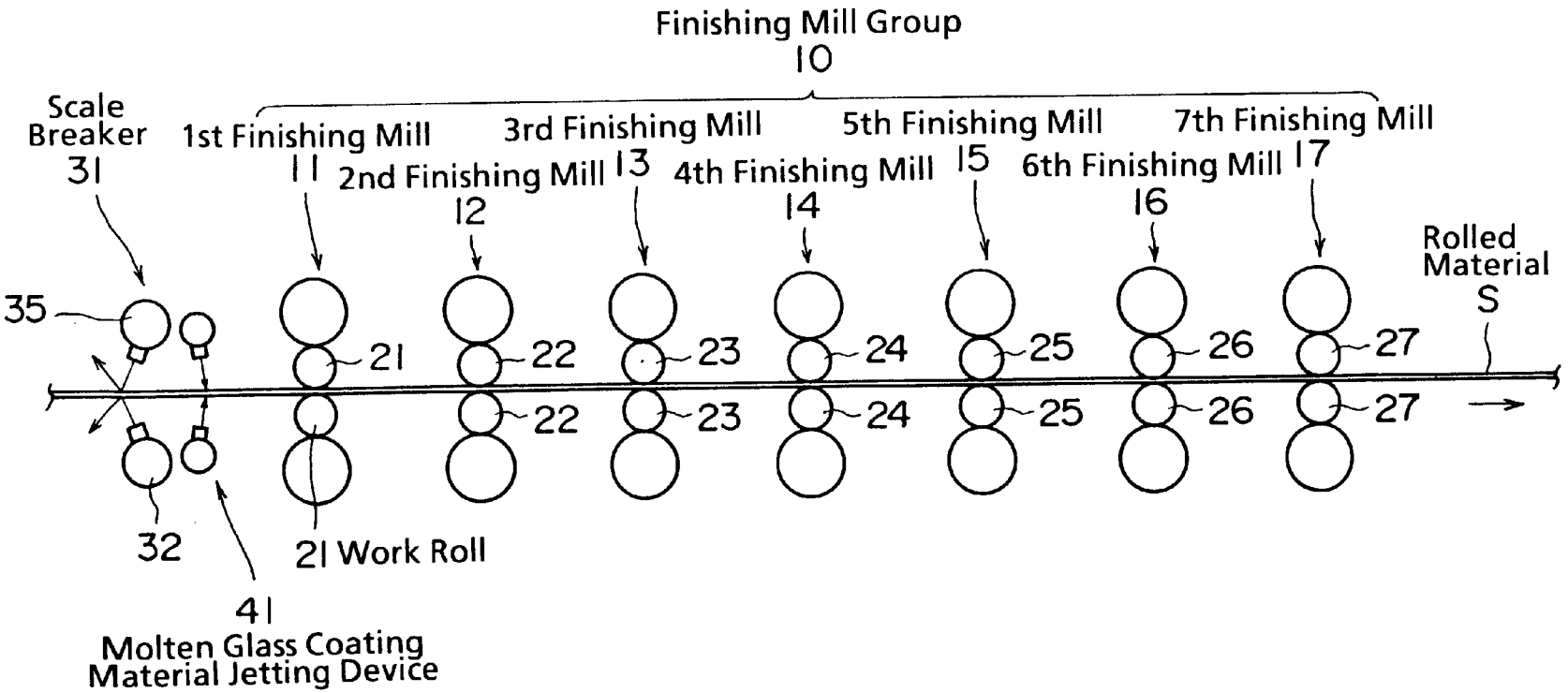
FIG. 1 is a schematic view illustrative of a scale formation suppressing system of a hot finishing mill system according to a first preferred embodiment of the present invention.
Figure 2:
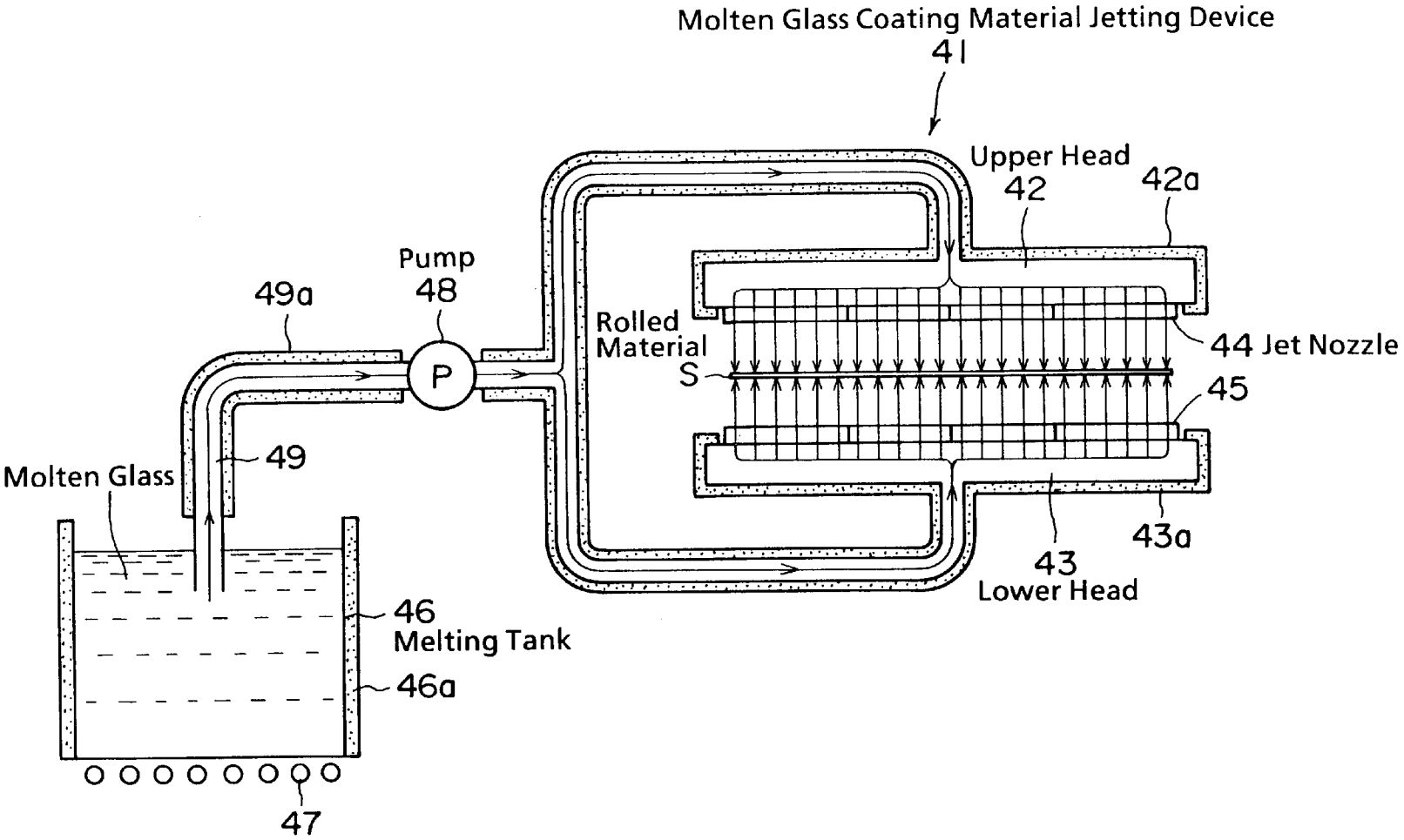
FIG. 2 is a schematic sectional view of a molten glass coating material jetting apparatus.
Figure 3:
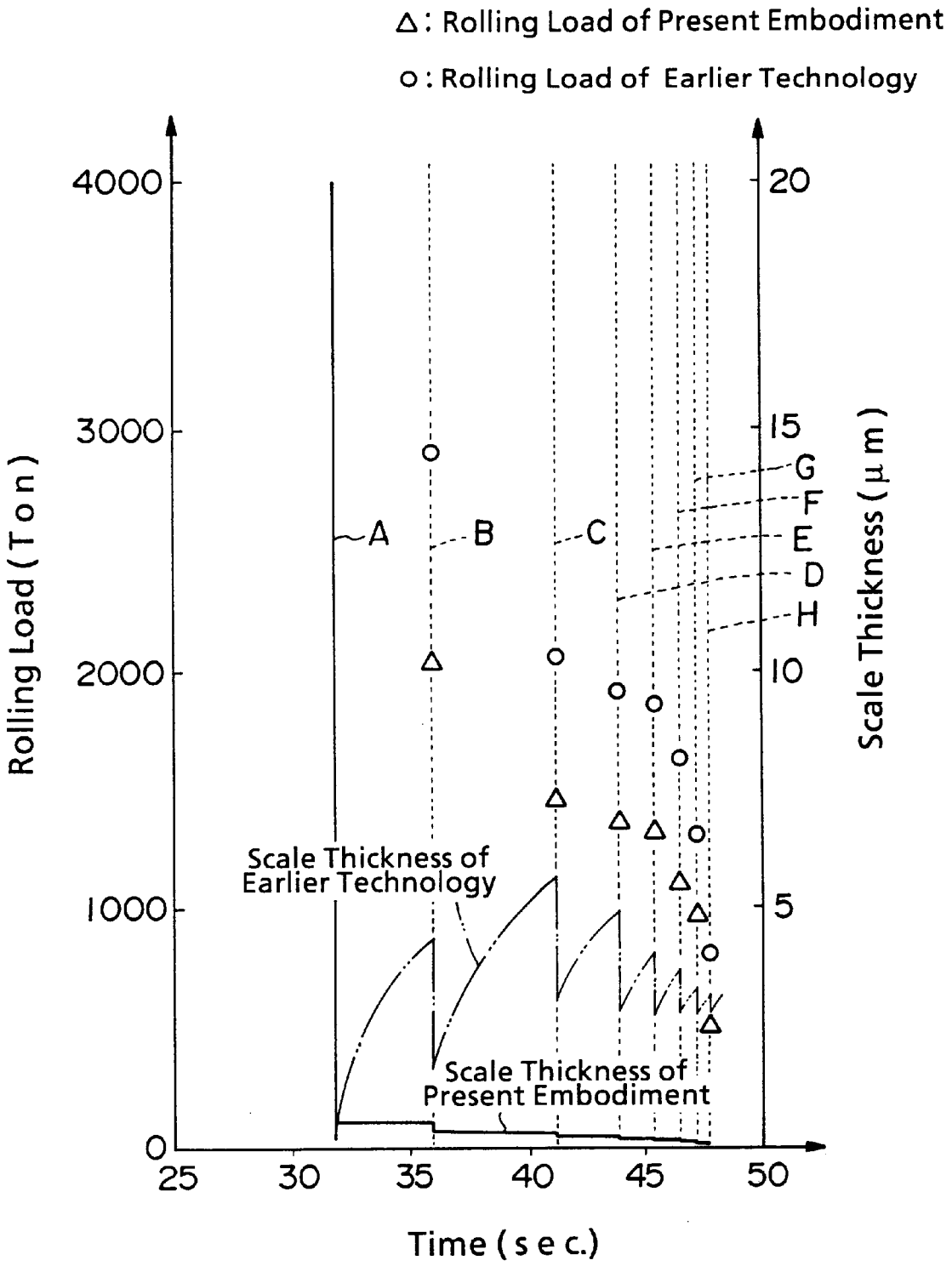
FIG. 3 is a graph showing the relationship of a rolling load and the thickness of scale during finish rolling by a scale formation suppressing system of a hot finishing mill system according to the present invention.

FIG. 1 is a schematic view of a scale formation suppressing system for performing a method for suppressing the formation of scale in a hot finishing mill system according to a first embodiment of the present invention. FIG. 2 is a schematic sectional view of a molten glass coating material application apparatus. FIG. 3 is a graph showing the relationship of a rolling load and the thickness of scale during finish rolling by a scale formation suppressing system of a hot finishing mill system according to the present invention.

With the system for suppressing scale formation in a hot finishing mill system according to the first embodiment as shown in FIG. 1, a plurality of finishing mills, i.e., a 1st finishing mill 11, a 2nd finishing mill 12, a 3rd finishing mill 13, a 4th finishing mill 14, a 5th finishing mill 15, a 6th finishing mill 17, and a 7th finishing mill are arranged in a row along the direction of transport of a rolled material S downstream of a roughing mill (not shown) in the direction of transport. The finishing mills 11 to 17 have a pair of (i.e., upper and lower) work rollers 21, 22, 23, 24, 25, 26, and 27, respectively. A finishing mill group 10 is thus constructed in this manner.

On the entry side of the finishing mill group 10, a scale breaker 31 is provided for removing scale formed on the rolled material S. The scale breaker 31 has a pair of (i.e., upper and lower) jet nozzles 32 above and below the rolled material S. These jet nozzles 32 direct jets of water at a high pressure of, say, 200 kgf/cm$^2$, to the upper and lower surfaces of the rolled material S to remove the scale.

At an entry side of the finishing mill group 10 (the 1st finishing mill 11) and at a delivery side of the scale breaker 31, a molten glass coating material application device 41 is provided for delivering molten glass in the form of a jet to the upper and lower surfaces of the rolled material S to form a molten glass film thereon. In the molten glass coating material application device 41 as shown in FIG. 2, an upper head 42 and a lower head 43 are disposed above and below the rolled material S, respectively. In the heads 42 and 43, slit-like jet nozzles 44 and 45, respectively, are formed opposite and relatively close to the rolled material S. A melting tank 46 storing molten glass is installed adjacent the heads 42 and 43 and a heater 47 is mounted to its underside. The melting tank 46 is connected to the heads 42 and 43 via a supply pipe 49 having a pump 48 midway. The upper head 42, the lower head 43, the melting tank 46, and the supply pipe 49 also included respective heat insulators 42*a*, 43*a*, 46*a* and 49*a*.

Thus, when the rolled material S is to be finish rolled by the hot finishing mill system of the embodiment shown in FIG. 1, the rolled material S, transported after rough rolling from a slab by a roughing mill, not shown, is conveyed to the entry side of the finishing mill group 10, where scale formed on the surfaces of the rolled material S is removed by the scale breaker 31 before finish rolling. In detail, water pressurized at, say, 200 kgf/cm$^2$, is jetted through the upper and lower jet nozzles 32 to the upper and lower surfaces of the conveyed rolled material S to remove the adhering scale.

Then, the molten glass coating material jet type of application device 41 jets molten glass to the upper and lower surfaces of the rolled material S to form a molten glass film thereon. As shown in detail in FIG. 2, molten glass is prepared and heated in the melting tank 46 by the heater 47. The molten glass is supplied to the upper head 42 and the lower head 43 through the supply pipe 49 upon actuation of the pump 48, and delivered to the upper and lower surfaces of the rolled material S by the jet nozzles 44, 45. As a result, a molten glass film is formed on the upper and lower surfaces of the rolled material S, whereby contact between air and the rolled material S is blocked in order to prevent the formation of scale.

The descaled, molten glass-coated, rolled material S is transported to the finishing mill group 10 for rolling by the work rollers 21, 22, 23, 24, 25, 26, and 27 of the respective finishing mills 11, 12, 13, 14, 15, 16, and 17. At this time, the rolled material S is kept out of contact with air because of the molten glass film formed on its surfaces.

Thus, the rolled material S is sequentially finish rolled to predetermined thicknesses without scale formation. The molten glass film formed on the surfaces of the rolled material S is effective as a satisfactory lubricating material, and can decrease the rolling load in the finishing mills 11 to 17.

FIG. 3 is a graph showing the relationship of rolling load and the thickness of scale during scale removal and finish rolling of the rolled material S. In this graph, the triangle Δ signifies the rolling load of the finishing mill of the hot finishing mill system of the aforementioned embodiment, the solid line represents the thickness of scale, A designates the time of scale removal by the scale breaker 31, and B, C, D, E, F, G, and H represent the times of finish rolling by the 1st to 7th finishing mills 11, 12, 13, 14, 15, 16, and 17, respectively. This graph shows that the scale thickness of the rolled material S decreases rapidly at the time A of scale removal by the scale breaker 31, and also decreases at the times B, C, D, E, F, G and H of finish rolling. Also, repeated rolling is found to reduce the thickness of the scale. The scale of the rolled material S is mostly removed at the time A of scale removal by the scale breaker 31, and the thickness of scale until the time B of finish rolling by the first finishing mill 11 remains almost unchanged (0.5 $\mu$m) relative to that at the time A of scale removal. These findings demonstrate that the formation of scale can be suppressed because the molten glass film is formed by the molten glass coating material jetting device 41 after the time A of scale removal. The rolled material S is rolled to decreased thicknesses at the times B, C, D, E, F, G, and H of finish rolling by the finishing mills 11 to 17, whereby the scale is extended to become sequentially thinner. It also discloses that the rolling load on the rolled material S having the molten glass film is decreasing.

Such formation of the molten glass film on the rolled material S immediately after removal of its scale can block its contact with air during finish rolling, and can finish roll it to predetermined plate thicknesses sequentially without scale formation. Furthermore, the molten glass film formed on the surfaces of the rolled material S acts as a good lubricating material, thus decreasing the rolling load in the finishing mills 11 to 17.

Figure 4:
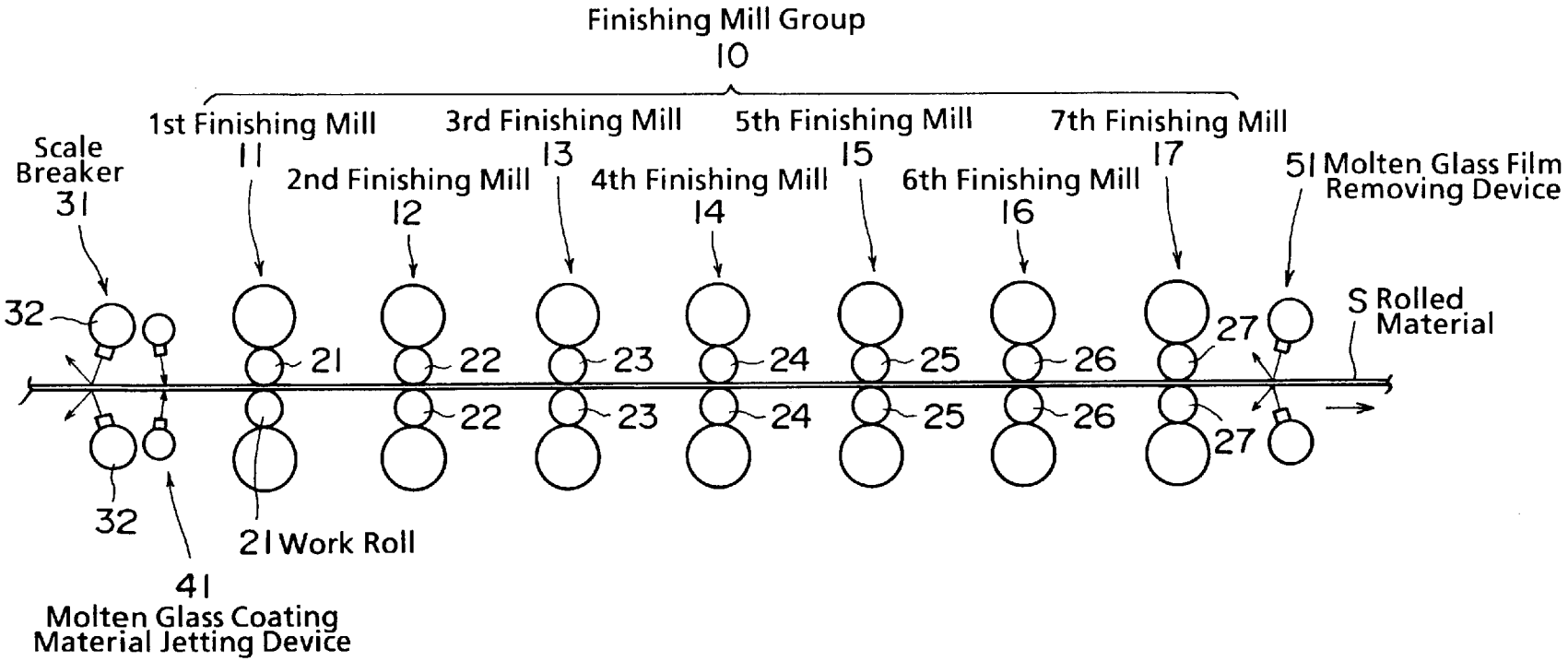
FIG. 4 is a schematic view illustrative of a scale formation suppressing system of a hot finishing mill system according to a second preferred embodiment of the present invention.

FIG. 4 is a schematic view of a scale formation suppressing system of a hot finishing mill system according to a second embodiment of the present invention. Members having the same functions as explained in the foregoing embodiment of FIG. 1 are assigned the same reference numerals, and overlapping explanations will be omitted.

With the system for suppressing scale formation in a hot finishing mill system according to the embodiment shown in FIG. 4, a finishing mill group 10 is composed of a plurality of finishing mills, i.e., 1st to 7th finishing mills, 11 to 17, arranged in a row along the direction of transport of a rolled material S. These finishing mills 11 to 17 have a pair of (i.e., upper and lower) work rollers 21 to 27, respectively. On the entry side of this finishing mill group 10, a scale breaker 31 is provided. The scale breaker 31 has a pair of (i.e., upper and lower) jet nozzles 32.

At the entry side of the finishing mill group 10 (the 1st finishing mill 11) and at a delivery side of the scale breaker 31, a molten glass coating material delivery device 41 is provided for jetting molten glass at upper and lower surfaces of the rolled material S to form a molten glass film. At the delivery side of the finishing mill group 10 (the 7th finishing mill 17), a molten glass film removing device 51 is located thereat for removing the molten glass film formed on the upper and lower surfaces of the rolled material S. This molten glass film removing device 51 has a pair of (i.e., upper and lower) jet nozzles, which direct jets of high pressure water toward and to the upper and lower surfaces of the rolled material S to remove the molten glass film remaining on these upper and lower surfaces.

Thus, when the rolled material S transported after rough rolling from a slab by a roughing mill is conveyed to the entry side of the finishing mill group 10, high pressure water is jetted through the jet nozzles 32 of the scale breaker 31 at the upper and lower surfaces of the rolled material S prior to finish rolling. By this measure, scale formed on the upper and lower surfaces of the rolled material S is removed. Then, molten glass is jetted through the jet nozzles of the molten glass coating material jetting device 41 at the upper and lower surfaces of the rolled material S to form a molten glass film on these surfaces, thereby blocking contact between the rolled material S and air. Then, the descaled, molten glass-coated, rolled material S is carried to the finishing mill group 10 for rolling by the respective finishing mills 11 to 17. At this time, the rolled material S is kept out of contact with air because of the molten glass film formed on its surfaces. Thus, the rolled material S is sequentially finish rolled to predetermined thicknesses without scale formation.

On the upper and lower surfaces of the rolled material S finish rolled to the predetermined plate thickness, the molten glass film remains. The molten glass film removing device 51 next removes the remaining film by jetting high pressure water at the upper and lower surfaces of the rolled material S through the upper and lower jet nozzles.

As described above, a molten glass film is formed immediately after scale of the rolled material S is removed. Thus, the rolled material S is blocked from contact with air during finish rolling, and can be finish rolled sequentially to predetermined thicknesses without scale formation. Removal of the molten glass film remaining on the upper and lower surfaces of the rolled material S, which has been finish rolled to a predetermined plate thickness, brings the rolled material S to a commercial stage.

Figure 5:
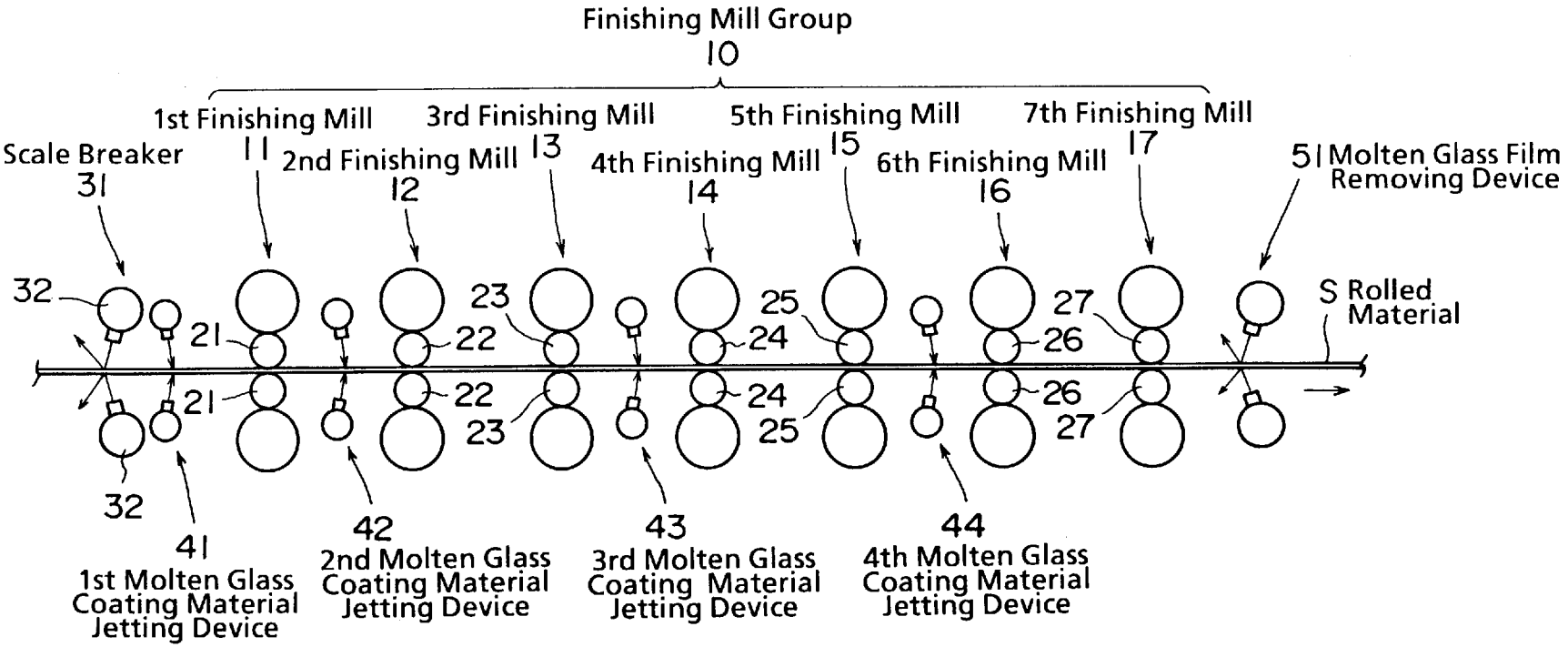
FIG. 5 is a schematic view illustrative of a scale formation suppressing system of a hot finishing mill system according to a third preferred embodiment of the present invention.
Figure 6:
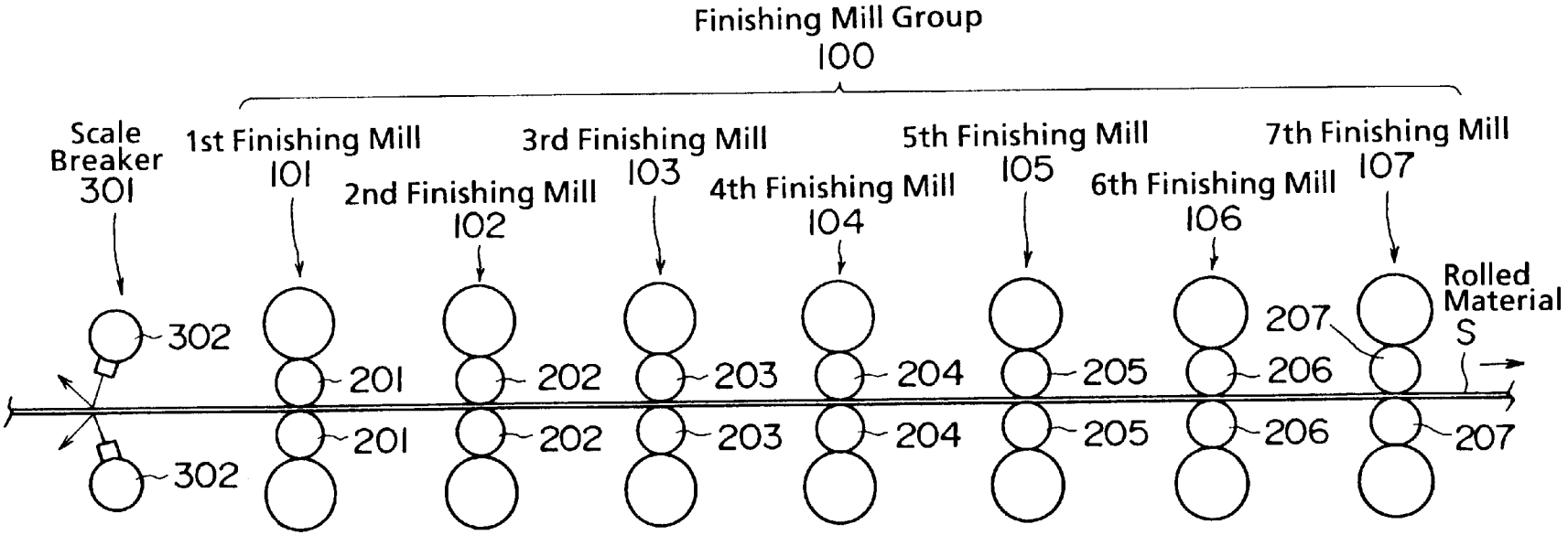
FIG. 6 PRIOR ART
FIG. 6 is a schematic view illustrative of a scale removing device of a conventional hot finishing mill system.

FIG. 5 depicts the outline of a scale formation suppressing system of a hot finishing mill system according to a third embodiment of the present invention. Members having the same functions as explained in the foregoing embodiments are assigned the same reference numerals, and overlapping explanations will be omitted.

With the system for suppressing scale formation in a hot finishing mill system according to the embodiment shown in FIG. 5, a finishing mill group 10 comprises a plurality of finishing mills, i.e., 1st to 7th finishing mills, 11 to 17, arranged in a row along the direction of transport of a rolled material S. These finishing mills 11 to 17 have a pair of (i.e., upper and lower) work rollers 21 to 27, respectively. On an entry side of this finishing mill group 10, a scale breaker 31 is provided. The scale breaker 31 has a pair of (i.e., upper and lower) jet nozzles 32.

At the entry side of the finishing mill group 10 (the 1st finishing mill 11) and at a delivery side of the scale breaker 31, a first molten glass coating material jet type of delivery device 41 is provided. At the delivery side of the finishing mill group 10 (the 7th finishing mill 17), a molten glass film removing device 51 is also provided. At the delivery side of any of (or all of) the finishing mills 11 to 17 in the finishing mill group 10, i.e., at the delivery side of each of the 1st, 3rd and 5th finishing mills 11, 13 and 15 according to the present embodiment, 2nd, 3rd, and 4th molten glass coating material application devices 42, 43, and 44 are provided for jetting molten glass at the upper and lower surfaces of the rolled material S to form a molten glass film.

Thus, when the rolled material S transported after rough rolling from a slab by a roughing mill is conveyed to the entry side of the finishing mill group 10, high pressure water is jetted through the jet nozzles 32 of the scale breaker 31 at the upper and lower surfaces of the rolled material S prior to finish rolling. By this measure, scale formed on the upper and lower surfaces of the rolled material S is removed. Then, molten glass is applied in the form of a jet through the jet nozzles of the 1st molten glass coating material jetting device 41 to the upper and lower surfaces of the rolled material S to form a molten glass film on these surfaces, thereby blocking contact between the rolled material Sand air. Then, the descaled, molten glass-coated, rolled material S is carried to the finishing mill group 10 for rolling by the 1st finishing mill 11. At this time, the rolled material S is kept out of contact with air because of the molten glass film formed on its surfaces. Thus, the rolled material S is finish rolled to a predetermined thickness without scale formation.

After rolling to the predetermined thickness by the 1st finishing mill 11, the molten glass film formed on the surfaces of the rolled material S is slightly thinned. Thus, after rolling by the 1st finishing mill 11, molten glass is again applied as a jet through the jet nozzles of the 2nd molten glass coating material jetting device 42 to the upper and lower surfaces of the rolled material S. By this measure, the molten glass film on both surfaces of the rolled material S is supplemented with the molten glass, and becomes thicker. The rolled material S with the supplemented molten glass film is further rolled by the 2nd and 3rd finishing mills 12, 13, whereafter the molten glass film on the upper and lower surfaces of the rolled material S is further supplemented with molten glass by the 3rd molten glass coating material jetting device 43. The rolled material S with the supplemented molten glass film is further rolled by the 4th and 5th finishing mills 14, 15, whereafter the molten glass film on the upper and lower surfaces of the rolled material S is supplemented yet again with molten glass by the 4th molten glass coating material jetting device 44. Finally, the rolled material S is finish rolled by the 6th and 7th finishing mills 16, 17 to a predetermined plate thickness.

On the upper and lower surfaces of the rolled material S finish rolled to the predetermined plate thickness, the molten glass film remains. The molten glass film removing device 51 then removes this remaining film by jetting high pressure water at the upper and lower surfaces of the rolled material S through the upper and lower jet nozzles.

As described above, a molten glass film is formed immediately after scale of the rolled material S is removed. Thus, the rolled material S is blocked from contact with air during finish rolling, and can be finish rolled sequentially to predetermined thicknesses without scale formation. During this process, molten glass is repeatedly jetted to the upper and lower surfaces of the rolled material S after rolling by the finishing mill, to supplement the molten glass film with additional molten glass. Thus, the molten glass film on the rolled material S can be kept at a constant thickness, so that contact between the rolled material S and air can be reliably prevented. Removal of the molten glass film remaining on the upper and lower surfaces of the rolled material S, which has been finish rolled to the predetermined plate thickness, can bring the rolled material S to a commercial stage.

In the foregoing embodiments, molten glass was used as a coating material jetted by the glass coating material jetting means of the present invention to form a molten glass film. However, when desired, powdered glass maybe used as the coating material. This material would be applied at the upper and lower surfaces of the rolled material S and thereafter heated at a high temperature, whereby the glass powder is melted to form a molten glass film.

As described in detail in the above embodiments, according to the first aspect of the invention, there is provide a method for suppressing the formation of scale in a hot finishing mill system during finish rolling of a strip material by a plurality of finishing mills arranged in a row and which comprises the steps of: removing scale at the entry side of the finishing mills; forming a molten glass film on the surfaces of the strip material; and, then finish rolling the strip material in this condition to a predetermined plate thickness. Thus, the rolled material can be finish rolled to the predetermined plate thickness without scale formation. Furthermore, the molten glass film formed on the surfaces of the rolled material is used as a satisfactory lubricating material. Therefor, the rolling load by the respective finishing mills can be decreased. Consequently, scale which would otherwise form on the rolled material is reliably suppressed, and the quality of the resulting product is improved.

According to the second aspect of the invention, there is provided the method for suppressing the formation of scale in the hot finishing mill system in accordance with the first aspect of the invention, wherein the molten glass film is removed at a delivery side of the most downstream finishing mill. Thus, the strip material can be easily commercialized.

According to the third aspect of the invention, there is provided a system for suppressing the formation of scale in a hot finishing mill system, comprising: a finishing mill for finish rolling a strip material, or a finishing mill group comprised of a plurality of finishing mills arranged in a row; scale removing means provided at an entry side of the finishing mill or the finishing mill group; and, glass coating material jet type delivery means for jetting a glass coating material to upper and lower surfaces of the strip material to form a molten glass film, the glass coating material delivery means being located at the entry side of the finishing mill or the finishing mill group and at a delivery side of the scale removing means. As noted from this, the molten glass film is formed immediately after scale of the strip material is removed. Thus, the strip material is blocked from contact with air during finish rolling, and can be finish rolled to a predetermined thickness without scale formation. Furthermore, the molten glass film formed on the surfaces of the strip material is used as a satisfactory lubricating material. Thus, the rolling load by the respective finishing mills can be decreased. Consequently, scale formation on the rolled material can be reliably suppressed, and the quality of the resulting product is improved.

According to the fourth aspect of the invention, there is provided the system for suppressing the formation of scale in the hot finishing mill system in accordance with the third aspect of the invention, wherein molten glass film removing means for removing the molten glass film formed on the upper and lower surfaces of the strip material is provided at the delivery side of the finishing mill or the finishing mill group. Thus, the strip material can be commercialized by removing, after finish rolling, the molten glass film that has been formed immediately after removal of scale from the strip material.

According to the fifth aspect of the invention, there is provided a system for suppressing the formation of scale in a hot finishing mill system, comprising: a finishing mill group including a plurality of finishing mills configured in a row for finish rolling a strip material; scale removing means provided at the entry side of the finishing mill group; first glass coating material jet type of application means for jetting a glass coating material to upper and lower surfaces of the strip material to form a molten glass film, the first glass coating material application means being located at the entry side of the finishing mill group and including one of the plurality of finishing mills at a delivery side of the scale removing means; second glass coating material jet type of application means for jetting a glass coating material at upper and lower surfaces of the strip material to form a molten glass film, the second glass coating material application means being provided at the delivery side of any of or all of the other finishing mills of the plurality of finishing mills of the other finishing mill group; and molten glass film removing means for removing the molten glass film formed on the upper and lower surfaces of the strip material, the molten glass film removing means being provided at the delivery side of the last finishing mill of finishing mill group. As noted from this, molten glass film is formed immediately after scale of the strip material is removed. Thus, the strip material is blocked from contact with air during finish rolling, and can be finish rolled to a predetermined thickness without scale formation. During this process, molten glass is repeatedly applied after rolling by the finishing mill to supplement the previously applied molten glass film with additional molten glass. Thus, the molten glass film on the strip material can be kept at a predetermined constant thickness, so that contact between the strip material and air can be reliably prevented. By removing the molten glass film after finish rolling, the strip material can be commercialized. Since scale formation on the rolled material can thus be reliably suppressed, the quality of the resulting product can be substantially improved.

Having thus shown and described what is at present considered to be the preferred method and embodiments of the subject invention, it should be noted that the same has been made by way of illustration and not limitation. Accordingly all changes, modifications and alterations coming within the spirit and scope of this invention as set forth in the appended claims, are herein meant to be included.

What is claimed is:

1. A system for suppressing formation of scale in a hot finishing mill system, comprising:

a molten glass providing unit arranged to provide molten glass;

a finishing mill group including a plurality of finishing mills arranged in a row for finish rolling a strip material;

scale removing means provided at an entry side of the finishing mill group;

first glass coating material application means for applying the molten glass onto upper and lower surfaces of the strip material to form a molten glass film, said first glass coating material application means being located at the entry side of the finishing mill group including one finishing mill of said plurality of finishing mills and at a delivery side of the scale removing means;

molten glass film removing means for removing the molten glass film formed on the upper and lower surfaces of the strip material, said molten glass film removing means being located at the delivery side of the finishing mill group; and second glass coating material application means for applying the molten glass onto the upper and lower surfaces of the strip material to form an additional molten glass film, said second glass coating material application means being provided at the entry side of any of a predetermined number of other finishing mills of the finishing mill group.

2. The system according to claim 1, further comprising:

molten glass film removing means at the delivery side of the finishing mill group.

3. The system according to claim 1, wherein said first and second glass coating material application means includes means for applying a jet of glass coating material on the upper and lower surfaces of the strip material.

4. The system of claim 1, wherein said a molten glass providing unit includes, a melting tank containing the molten glass, a heater for heating the tank, at least one head having a jet nozzle, and a pump arranged to provide the molten glass to said at least one head to spray the molten glass onto at least one of the upper and lower surfaces of the strip material.

5. The system according to claim 2, wherein said finishing mill includes the first finishing mill of the finishing mill group.

6. The system according to claim 2, wherein said predetermined number of other finishing mills includes at least one finishing mill of said other finishing mills.

7. The system according to claim 2, wherein said predetermined number of other finishing mills includes a plurality of finishing mills of said other finishing mills.

8. The system according to claim 2, wherein said predetermined number of other finishing mills includes all of the finishing mills of said other finishing mills.

9. A system for suppressing formation of scale in a hot finishing mill system, comprising:

a molten glass providing unit arranged to provide a molten glass;

at least one finishing mill for finish rolling a strip material;

scale removing means provided at an entry side of said at least one finishing mill; and glass coating material application means for applying the molten glass on upper and lower surfaces of the strip material to form a mol ten glass film, said glass coating material application means being located at the entry side of said at least one finishing mill and at a delivery side of the scale removing means.

10. The system for suppressing formation of scale in the hot finishing mill system according to claim 9, further comprising:

molten glass film removing means for removing the molten glass film formed on the upper and lower surfaces of the strip material located at the delivery side of the hot finishing mill system.

11. The system according to claim 9, wherein said hot finishing mill system includes a plurality o finishing mills, and wherein said scale removing means is located at the delivery side of the last one of said plurality of finishing mills.

12. The system of claim 9, wherein said a molten glass providing unit includes, a melting tank containing the molten glass, a heater for heating the tank, at least one head having a jet nozzle, and a pump arranged to provide the molten glass to said at least one head to spray the molten glass onto at least one of the upper and lower surfaces of the strip material.

13. The system according to claim 11, wherein said plurality of finishing mills are arranged in a linear configuration.

14. A method for suppressing formation of scale in a hot finishing mill system during finish rolling of a strip material by a plurality of finishing mills located in a row, comprising:

providing a molten glass;

removing the scale at an entry side of the finishing mills;

forming a molten glass film on the surfaces of the strip material by applying the molten glass on the surfaces of the strip material; and finish rolling the strip material with the molten glass film formed thereon to a predetermined plate thickness.

15. The method for suppressing the formation of scale in the hot finishing mill system according to claim 14, further comprising:

removing the molten glass film at a delivery side of the most downstream finishing mill.

16. The method of claim 15, wherein said step of forming a molten glass film includes forming the molten glass film on the surfaces of the strip material at the entry side of at least the first one of said plurality of finishing mills.

17. The method of claim 15, wherein said step of forming a molten glass film includes forming said glass film at the entry side of a predetermined number of said finishing mills.

18. The method of claim 15, wherein said step of forming a molten glass film includes forming said glass film at the entry side of all said finishing mills.

19. The method of claim 14, wherein said step of forming a molten glass film includes the step of applying a jet of molten glass onto the surfaces of the strip material.

* * * * *